US005240061A

United States Patent [19]

Watson et al.

[11] Patent Number: 5,240,061

[45] Date of Patent: Aug. 31, 1993

[54] SUBSTRATE FOR SPRAY CAST STRIP

[75] Inventors: W. Gary Watson, Cheshire; Harvey P. Cheskis, North Haven; Sankaranarayanan Ashok, Bethany, all of Conn.; Charles R. Pratt, Neath, United Kingdom

[73] Assignee: Osprey Metals Limited, West Glamorgan, United Kingdom

[21] Appl. No.: 898,650

[22] Filed: Jul. 24, 1992

Related U.S. Application Data

[63] Continuation of Ser. No. 635,090, Dec. 28, 1990.

[51] Int. Cl.[5] ..... B22D 23/00; B22D 11/06

[52] U.S. Cl. ..... 164/46; 164/463; 164/479

[58] Field of Search ..... 164/46, 463, 429, 461, 164/419, 479; 118/325; 427/424

[56] References Cited

U.S. PATENT DOCUMENTS

| | | | |
|---|---|---|---|
| 2,639,490 | 5/1953 | Brennan | 118/325 |
| 2,772,454 | 12/1956 | Brennan | 164/461 |
| 3,742,585 | 7/1973 | Wentzell | 164/46 |
| 4,086,952 | 5/1978 | Olsson | 164/419 |
| 4,782,884 | 11/1988 | Siemers | 164/46 |

*Primary Examiner*—Kuang Y. Lin
*Attorney, Agent, or Firm*—Paul Weinstein

[57] ABSTRACT

A molten metal gas-atomizing spray-depositing apparatus has an atomizer which employs a pressurized gas flow for atomizing a stream of molten metal into a spray pattern of metal particles being initially hotter than the solidus temperature of the metal. The apparatus also has a substrate system which includes an outer substrate of metallic foil and an inner substrate for supporting the outer substrate. The outer foil substrate is movable relative to the metal particles in the spray pattern thereof and disposed below the atomizer for receiving on a surface of the foil a deposit of the particles in the spray pattern to form a product on the outer foil substrate. The outer foil substrate is of a thickness which is less than a predefined maximum thickness at which the capacity of the foil to absorb heat from the deposit is equal to the latent heat and super heat, if present, of the deposit. The foil thickness precludes reduction in temperature below the solidus temperature, and thereby complete solidification, of the metal particles forming the deposit upon initial contact with the foil surface whereby a reduction of porosity is achieved in the deposit.

10 Claims, 2 Drawing Sheets

SUBSTRATE FOR SPRAY CAST STRIP

This application is a continuation of application Ser. No. 07/635,090, filed Dec. 28, 1990.

BACKGROUND OF THE INVENTION

1. Field of the Invention

The present invention generally relates to spray-deposited production of a product on a moving substrate and, more particularly, is concerned with use of a thin foil of preselected thickness as an outer substrate for reducing heat absorption to preclude complete solidification of the deposit on the outer foil substrate.

2. Description of the Prior Art

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R. W. Evans et al, Powder Metallurgy, Vol. 28, No. 1 (1985), pages 13–20 and "The Osprey Process for the Production of Spray-Deposited Roll, Disc, Tube and Billet Preforms" by A. G. Leatham et al, Modern Developments in Powder Metallurgy, Vols. 15–17 (1985), pages 157–173.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a preforming mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in European Pat. Appln. No. 225,080. For producing these products, a substrate or collector, such as a flat substrate or an endless belt is moved continuously through the spray to receive a deposit of uniform thickness across its width.

Heretofore, extensive porosity typically has been observed in a spray-deposited preform at the bottom thereof being its side in contact with the substrate or collector. This well known phenomenon, normally undesirable, is a particular problem in a thin gauge product, such as strip or tube, since the porous region may comprise a significant percentage of the product thickness. The porosity is thought to occur when the initial deposit layer is cooled too rapidly by the substrate, providing insufficient liquid to feed the inherent interstices between splatted droplets.

Another defect feature often associated with this substrate region is extensive lifting of initial splats which promotes a non-flat surface. The lifting of the splats is a consequence of solidification contraction and distortion arising from the rapid solidification of the splats.

One approach of the prior art for eliminating these problems is preheating the substrate to minimize or reduce the rate of heat transfer from the initial deposit to the substrate so that some fraction liquid is always available to feed voids created during the spray deposition process. However, it is often difficult to effectively preheat a substrate in a commercial spray deposit system because of the cooling effects of the high velocity recirculating atomizing gas. Further, preheating a substrate increases the potential for the deposit sticking to the substrate.

Therefore, a need exists for an alternative approach to elimination of the porosity problem particularly in thin gauge product produced by the above-described Osprey spray-deposition process.

SUMMARY OF THE INVENTION

The present invention provides a limited heat-absorptive outer thin foil substrate designed to satisfy the aforementioned needs. The unique feature of a foil lies in its limited heat absorption capabilities. The thickness of the thin foil can be selected so as to limit its heat absorption capacity, resulting in at most only partial melting of the foil surface and bonding with the initial spray deposit layer without extensive heat transfer to the cold inner substrate underlying the outer foil substrate. Thus, a sufficiently thin foil will ensure that the initial spray deposit layer will not fully solidify. The availability of an adequate fraction of liquid in the initial deposit layer will consequently minimize porosity and promote a fully dense bottom surface.

Accordingly, the present invention is directed to a molten metal gas-atomizing spray-depositing apparatus. The apparatus includes the combination of: (a) means employing a pressurized gas flow for atomizing a stream of molten metal into a spray pattern of metal particles being initially hotter than the solidus temperature of the metal; and (b) a substrate of metallic foil disposed below the atomizing means for receiving on a surface of the foil a deposit of the particles in the spray pattern to form a product thereon. The metallic foil is of a thickness which is less than a predefined maximum thickness at which the capacity of the foil to absorb heat from the deposit is equal to the latent heat and super heat, if present, of the deposit. The foil thickness thus precludes reduction in temperature below the solidus temperature of the deposit and thereby complete solidification, of metal particles forming the deposit upon initial contact with the foil surface whereby a reduction of porosity is achieved in the deposit.

More particularly, the apparatus includes a substrate system which has an outer substrate in the form of the metallic foil and an inner substrate for supporting the outer substrate. The outer foil substrate is movable relative to the metal particles in the spray pattern thereof. In one embodiment, the inner substrate is a stationary structure, whereas in another embodiment the inner substrate is an endless belt being movable with the outer substrate relative to the atomizing means and the metal particles in the spray pattern. The outer substrate is metallurgically separate from the inner substrate such that, in effect, a gap exists between the substrates which is non-conductive to heat transfer therebetween.

Also, the predefined maximum thickness of the outer foil substrate is derived by equating the latent heat and super heat, if present, of the deposit with the heat the foil substrate is capable of absorbing between its lower steady state temperature and the higher deposit solidus temperature without it fully melting through. The steady state temperature of the outer foil substrate is substantially determined by the steady state temperature of the pressurized gas employed by the atomizing means.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

1. Prior Art Spray-Deposition Apparatus

Figure 1:
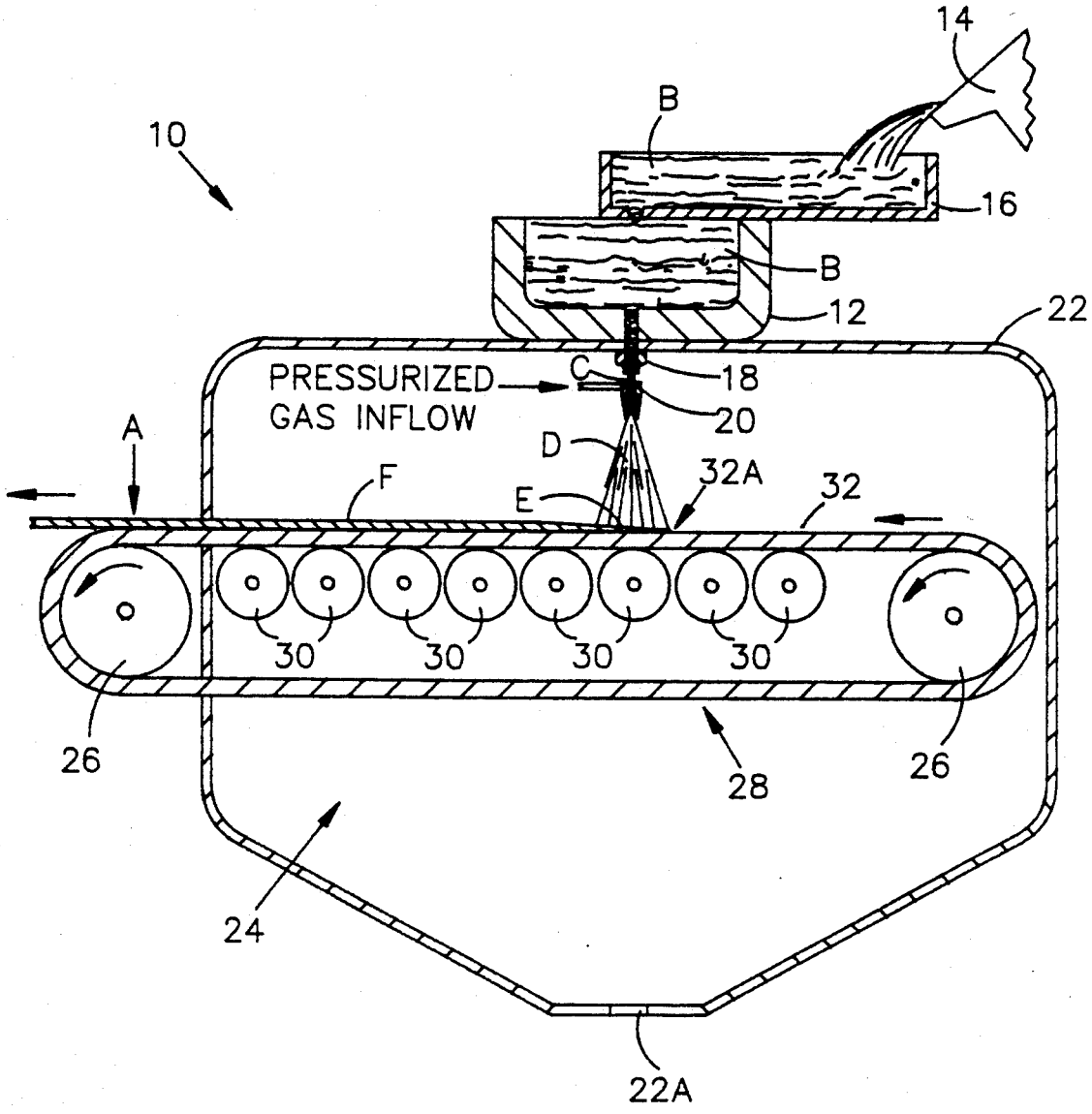
FIG. 1 is a schematic view, partly in section, of a prior art spray-deposition apparatus for producing a product on a moving substrate, such as in thin gauge strip form.

Referring now to the drawings, and particularly to FIG. 1, there is schematically illustrated a prior art spray-deposition apparatus, generally designated by the numeral 10, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downward from the tundish 12. Also, a gas atomizer 20 employed by the apparatus 10 is positioned below the tundish bottom nozzle 18 within a spray chamber 22 of the apparatus 10. The atomizer 20 is supplied with a gas, such as nitrogen, under pressure from any suitable source. The atomizer 20 which surrounds the molten metal stream C impinges the gas on the stream C so as to convert the stream into a spray D of atomized molten metal particles, broadcasting downward from the atomizer 20 in the form of a divergent conical pattern. If desired, more than one atomizer 20 can be used. Also, the atomizer(s) can be moved transversely in side-to-side fashion for more uniformly distributing the molten metal particles.

Further, a continuous substrate system 24 employed by the apparatus 10 extends into the spray chamber 22 in generally horizontal fashion and in spaced relation below the gas atomizer 20. The substrate system 24 includes drive means in the form of a pair of spaced rolls 26, an endless substrate 28 in the form of a flexible belt entrained about and extending between the spaced rolls 26, and a series of rollers 30 which underlie and support an upper run 32 of the endless substrate 28. The substrate 28 is composed of a suitable material, such as stainless steel. An area 32A of the substrate upper run 32 directly underlies the divergent pattern of spray D for receiving thereon a deposit E of the atomized metal particles to form the metal strip product A. The atomizing gas flowing from the atomizer 20 is much cooler than the molten metal B in the stream C. Thus, the impingement of atomizing gas on the spray particles during flight and subsequently upon receipt on the substrate 28 extracts heat therefrom, resulting in lowering of the temperature of the metal deposit E below the solidus temperature of the metal B to form the solid strip F which is carried from the spray chamber 22 by the substrate 28 from which it is removed by a suitable mechanism (not shown). A fraction of the particles overspray the substrate 28 and fall to the bottom of the spray chamber 22 where they along with the atomizing gas flow from the chamber via an exhaust port 22A.

2. Modifications of the Present Invention

In the prior art apparatus 10, the solid strip F formed on the substrate 28 typically exhibits extensive porosity in its bottom side adjacent the substrate. The cause of this porosity problem is believed to be due to contact with the cool substrate 28 which together with the impingement of the cool atomizing gas extracts too much heat and thereby lowers the temperature of the spray deposit E too rapidly, starving it of a sufficient fraction of liquid to feed the interstices between splatted droplets.

The solution of the present invention is to employ an outer moving substrate 34 in the form of a thin foil, preferably of metallic material such as a copper alloy. The unique feature of the foil 34 is its limited heat absorption capability. The outer thin foil substrate 34 has a thickness selected to sufficiently reduce and limit heat extraction from the metal particles forming the deposit E when they initially come in contact with the outer surface 34A of the foil 34 so as to prevent complete solidification of the initial deposit E and thereby permit production of a dense strip product A having minimal porosity.

The thickness of the thin foil outer substrate 34 selected to limit heat absorption from the deposit E will be sufficient to allow, at most, only partial melting, if any, of the outer surface 34A of the foil substrate 34 and bonding of the deposit E thereto. The deposit E will be carried from the spray chamber with the moving outer foil substrate 34, there being no chance of the deposit sticking to the inner substrate 28. If the foil 34 is bonded to the product A, it will be removed by subsequent conventional milling operations.

Figure 2:
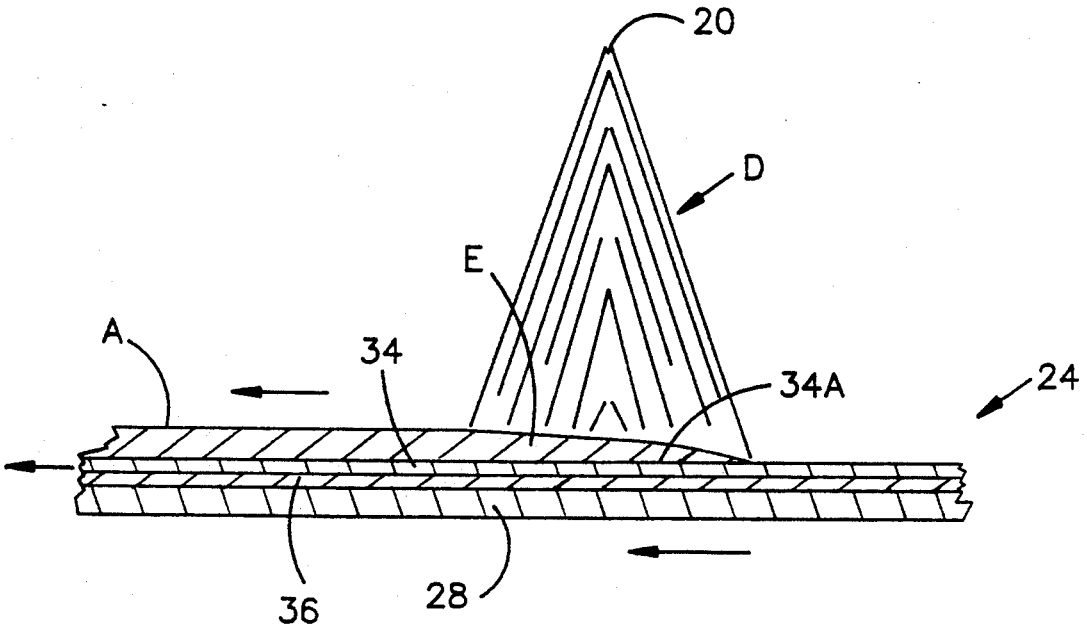
FIG. 2 is an enlarged fragmentary schematic sectional view of one modified form of the spray-deposition apparatus substrate in accordance with the present invention.
Figure 3:
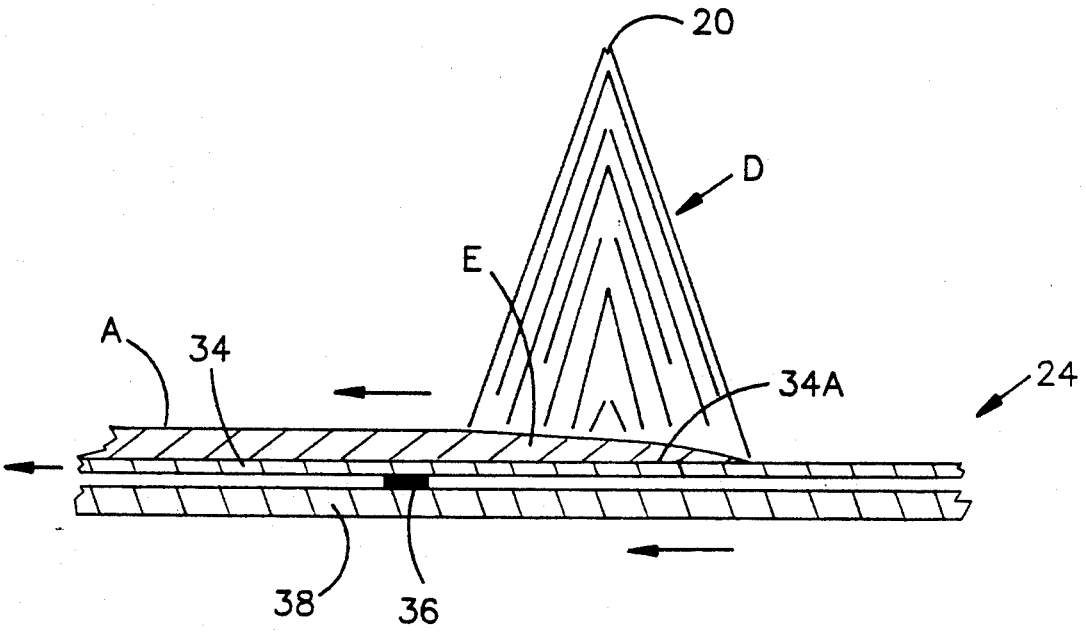
FIG. 3 is an enlarged fragmentary schematic sectional view of another modified form of the substrate.

The inner substrate 28 which physically supports the outer substrate 34 can be the endless continuously moving substrate 28 as used in the apparatus 10 shown in FIG. 1 and also in FIG. 2. On the other hand, the inner substrate can alternatively take the form of a stationary support platform or table 38, as seen in FIG. 3. However, in both embodiments, the outer foil substrate 34 is metallurgically separate from the inner substrate 28 or 38 so that, in effect, a gap defining non-conductive ceramic material 36 exists between the outer and inner substrates 34, 38 which does not conduct heat to any appreciable degree between them. In FIG. 2, the gap is defined by a non-conductive ceramic material 36 connecting the substrates together.

To recapitulate, the metallic foil substrate 34 is of a thickness which is less than a predefined maximum thickness at which the capacity of the foil to absorb heat from the deposit is equal to the latent heat and super heat, if present, of the deposit. The foil thickness thus precludes reduction in temperature below the solidus temperature of the deposit and complete solidification of the metal particles forming the deposit E upon initial contact with the foil surface 34A whereby a reduction of porosity is achieved in the deposit. The predefined maximum thickness of the outer foil substrate 34 is derived by equating the latent heat and superheat, if any, of the deposit E with the heat the foil substrate 34 is capable of absorbing between its steady state temperature and the deposit solidus temperature. The steady state temperature of the outer foil substrate 34 is substantially determined by the steady state temperature of the pressurized gas employed by the atomizer 20. Thus, the thickness of the thin metallic foil substrate 34 is preselected to set the capacity of the foil 34 to absorb heat from the deposit E at a maximum limit which prevents complete solidification of the initial metal particles forming the initial part of the deposit E, whereby a fraction of liquid will be present to wet subsequent metal particles contacting the foil surface 34A.

The following example demonstrates how the thickness of the outer thin foil substrate 34 is selected or arrived at to ensure that insufficient heat will be absorbed or extracted from the deposit E to allow it to completely solidify and produce porosity in its bottom surface.

EXAMPLE

A Cu-base alloy forms the spray deposit on a Cu-base foil substrate. Assume the initial spray deposit layer is 0.7 mm thick and contains 0.3 fraction liquid (fl) upon arrival at the substrate. In order for the initial estimated 0.7 mm layer to fully solidify all latent heat from the 0.3 fraction liquid must be transferred to the foil. The latent heat content per unit area is, $$Q=(pd)(xd)(Hd)(fl)$$

where pd, xd, Hd are the density, thickness and heat of fusion of the deposit (d) respectively. Therefore, for a Cu-base alloy, $$\begin{aligned} Q &= (8.9\ \text{g/cm3})(0.07\ \text{cm})(50\ \text{cal/g})(0.3) \\ &= 9.35\ \text{cal/cm2}. \end{aligned}$$

In order that the foil substrate absorb less than this amount of heat it must increase in temperature to the deposit solidus temperature Ts (assume no kinetic limitations). Thus, the foil thickness may be calculated by equating the heat absorbed by the foil (subject to this solidus temperature constraint) to the latent heat of the metal deposit layer(s), $$Q=(Pf)(xf)(Cf)(Ts\text{-}Ti)=9.35\ \text{cal/cm2}$$

where pf, xf, Cf are the density, thickness and heat capacity of the foil (f) respectively. Therefore, $$\begin{aligned} xf &= \frac{9.35\ \text{cal/cm2}}{(8.9\ \text{g/cm3})(0.1\ \text{cal/g-degrees C.})(Ts\text{-}Ti)} \\ &= (9.35/0.89)(Ts\text{-}Ti)\ \text{cm} \end{aligned}$$

where 0.1 cal/g-degrees C. is the heat capacity of the foil and (Ts-Ti) is the temperature interval over which the foil must be heated up to the deposit solidus temperature.

If Ti is the temperature of the estimated steady state recirculating N2 gas value of=400 degrees C. (thus the initial or steady state temperature of the foil is the same) and Ts, the solidus temperature of Cu-based alloy is 1080 degrees C., then $$(9.35/0.89)(680)=0.015\ \text{cm}=0.006\ \text{inch}$$

Therefore, if the foil thickness (xf) is less than the above respective values, then complete solidification of the initial deposit by the foil substrate should not occur and a dense deposit should result.

The above calculations will be similar in the case of a steel foil substrate. Steel foil may be preferred in some cases depending upon the temperature of the alloy being cast as steel has a higher melting point than that of copper. The steel used may be in any alloyed form ranging from low carbon steel to stainless steel.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. A method of a molten metal gas-atomizing spray-deposition, comprising the steps of:

(a) employing a pressurized gas flow for atomizing a stream of molten metal at a spray rate into a spray pattern of metal particles being initially hotter than the solidus temperature of the metal; and (b) disposing a substrate of a metallic foil below said atomizing means for receiving on a surface of said foil a deposit of said particles in said spray pattern to form a product thereon, said metallic foil being of a thickness which is less than a predefined maximum thickness at which the capacity of said foil to absorb heat at said spray rate from initially received particles of said deposit during the time period from initial receipt of said particles on the foil until such time as additional particles are deposited on top of the initially received particles is equal to the latent heat and super heat, if present, of said initially received particles of said deposit, whereby a reduction of porosity is achieved in said deposit.

2. The method as recited in claim 1, wherein said substrate of metallic foil is moved relative to said atomizing means and said metal particles in said spray pattern thereof during the spraying.

3. The method as recited in claim 1, wherein said predefined maximum thickness of said metallic foil is derived by equating the latent heat and super heat, if present, of said deposit with the heat said foil is capable of absorbing between its lower steady state temperature, at which deformation of already deposited particles in said deposit by the particles in said spray is not possible, and the higher deposit solidus temperature, at which such deformation is possible.

4. The method as recited in claim 3, wherein said steady state temperature of said metallic foil is substantially determined by the steady state temperature of said pressurized gas employed by said atomizing means.

5. A molten metal gas-atomizing spray-depositing method, comprising the steps of:

(a) employing a pressurized gas flow for atomizing a stream of molten metal at a spray rate into a spray pattern of metal particles being initially hotter than the solidus temperature of the metal; and (b) disposing in the spray pattern a substrate system including an outer substrate of metallic foil and an inner substrate for supporting said outer substrate;

(c) and moving said outer substrate of metallic foil relative to said metal particles in said spray pattern thereof below said atomizing means so as to receiving on a surface of said foil a deposit of said particles in said spray pattern to form a product on said outer substrate, said metallic foil being of a thickness which is less than a predefined maximum thickness at which the capacity of said foil to absorb heat at said spray rate from initially received particles of said deposit during the time period from initial receipt of said particles on the foil until such time as additional particles are deposited on top of the initially received particles is equal to the latent heat and super heat, if present, of said initially received particles of said deposit, whereby a reduction of porosity is achieved in said deposit.

6. The method as recited in claim 5, wherein said inner substrate is a stationary structure.

7. The method as recited in claim 5, wherein said inner substrate is an endless belt being movable with said outer substrate relative to said atomizing means and said metal particles in said spray pattern thereof.

8. The method as recited in claim 5, wherein said predefined maximum thickness of said metallic foil is derived by equating the latent heat and super heat, if present, of said deposit with the heat said foil is capable of absorbing between its lower steady state temperature, at which deformation of already deposited particles in said deposit by the particles in said spray is not possible, and the higher deposit solidus temperature, at which such deformation is possible.

9. The method as recited in claim 8, wherein said steady state temperature of said outer foil substrate is substantially determined by the steady state temperature of said pressurized gas employed by said atomizing means.

10. The method as recited in claim 5, wherein said outer foil substrate is metallurgically separate from said inner substrate such that, in effect, a gap exists between said substrates which is of negligible conductivity to heat transfer therebetween.

* * * * *